US006574895B2

(12) United States Patent
Nestor et al.

(10) Patent No.: US 6,574,895 B2
(45) Date of Patent: Jun. 10, 2003

(54) SIGN FRAME ASSEMBLY AND SYSTEM FOR ADVERTISING

(75) Inventors: Lynn Nestor, Mechanicsburg, PA (US); Francis Nestor, Mechanicsburg, PA (US); Michael R. Pavone, Camp Hill, PA (US); John L. Hergenroeder, York Haven, PA (US)

(73) Assignee: Roadshows, L.L.C., Camp Hill, PA (US)

( * ) Notice: Subject to any disclaimer, the term of this patent is extended or adjusted under 35 U.S.C. 154(b) by 162 days.

(21) Appl. No.: 09/779,298

(22) Filed: Feb. 8, 2001

(65) Prior Publication Data

US 2002/0104245 A1 Aug. 8, 2002

Related U.S. Application Data

(60) Provisional application No. 60/181,524, filed on Feb. 10, 2000.

(51) Int. Cl.[7] ..... G09F 17/00
(52) U.S. Cl. ..... 40/603; 40/590
(58) Field of Search ..... 40/603, 590; 38/102.91

(56) References Cited

U.S. PATENT DOCUMENTS

| | | | | | |
|---|---|---|---|---|---|
| 4,580,361 | A | | 4/1986 | Hillstrom et al. | 40/603 |
| 4,756,107 | A | | 7/1988 | Hillstrom | 40/603 |
| 5,058,299 | A | * | 10/1991 | Suzuki | 40/603 |
| 5,140,765 | A | | 8/1992 | King | 40/603 |
| 5,507,109 | A | * | 4/1996 | Rinzler | 40/603 |
| 5,649,730 | A | | 7/1997 | Ramos | 40/611 X |
| 5,685,099 | A | | 11/1997 | Favata | 40/590 |
| 6,041,535 | A | * | 3/2000 | Holloway et al. | 40/603 |
| 6,088,942 | A | | 7/2000 | Brooks et al. | 40/603 |
| 6,167,649 | B1 | * | 1/2001 | Palmeri | 40/603 |
| 6,209,245 | B1 | * | 4/2001 | Wittenberg | 40/603 |
| 6,250,002 | B1 | * | 6/2001 | Wittenberg | 40/603 |
| 6,339,889 | B1 | * | 1/2002 | Griesemer et al. | 40/603 |
| 6,393,746 | B1 | * | 5/2002 | Jacobson | 40/603 X |

* cited by examiner

*Primary Examiner*—Joanne Silbermann
(74) *Attorney, Agent, or Firm*—Duane Morris LLP

(57) ABSTRACT

A sign frame assembly for holding and displaying a flexible sign on a mounting surface includes a plurality of channel assembly tracks, a plurality of base assembly tracks and a plurality of fasteners. The channel assembly tracks have a channel containing member which receives and holds a beaded sleeve of the sign. The base assembly tracks include an anchoring member which serves as a pivot point for anchoring and mounting the channel assembly track onto the base assembly track. The channel assembly tracks are used to form all sides of the frame and the base assembly tracks are used to form at least two sides of the frame.

28 Claims, 16 Drawing Sheets

SIGN FRAME ASSEMBLY AND SYSTEM FOR ADVERTISING

This Application claims priority from Provisional Patent Application Serial No. 60/181,524, filed on Feb. 10, 2000, and titled SIGN FRAME.

FIELD OF THE INVENTION

The invention generally relates to a sign frame assembly and system for advertising, and more particularly to a frame assembly for tautly holding stretchable or flexible sign panels to mounting surfaces such as the sides of tractor trailers.

BACKGROUND OF THE INVENTION

Vehicles such as tractor trailers are often fitted with signs mounted to their surfaces for the purpose of advertising. Typically, the signs are made of a flexible material such as canvas or flexible plastic and are mounted onto the surface of the vehicle via a frame assembly. The frame assembly securely and tautly holds the sign through a combination of frame members and tensioning devices.

Systems for advertising including signs held by sign frame assemblies mounted on mounting surfaces such as the sides of tractor trailers or other vehicles are well known in the art. Examples are disclosed in U.S. Pat. Nos. 4,580,361—Hillstrom et al.; 5,685,099—Favata; 4,756,107—Hillstrom; and 5,649,730—Ramos. These patents teach various apparatus, methods and systems for the mounting of signs to the sides of vehicles, and are hereby incorportated. Other patents disclosing sign frame assemblies employing tensioning devices include U.S. Pat. No. 5,140,765—King; and 6,088,942—Brooks et al., and are hereby incorporated.

Current sign frame assemblies typically include several piece tensioning devices, or intricately designed tensioning devices which are complex and expensive to make. Such tensioning devices may include fasteners, springs or clips which may cause damage to the sign material and are often difficult or labor intensive to use. Use of such tensioning devices also often causes damage to the mounting surface, such as scratches to the sides of vehicles.

Thus, there is currently a need for a simpler and cheaper sign frame assembly and tensioning system.

SUMMARY OF THE INVENTION

The present invention is a sign frame assembly for mounting a flexible sign onto a mounting surface. The sign frame assembly comprises a plurality of channel assembly tracks, a plurality of base assembly tracks, and a plurality of fasteners. The channel assembly tracks include a channel containing member. The base assembly tracks include an anchoring member. The channel assembly tracks are used to form all sides of the frame and the base assembly tracks are used to form at least two sides of the frame. At least two channel assembly tracks are mounted on top of at least two base assembly tracks by fasteners.

According to another aspect of the invention, a sign is mounted to the sign frame assembly. The sign comprises a sign panel and a plurality of beaded sleeves. The beaded sleeves are attached, one each, to each side of the sign panel. The beaded sleeves are held within a cavity of the channel containing member of the channel assembly tracks.

According to another aspect of the invention, the sign and sign frame assembly are part of a system for advertising. The system for advertising includes a mounting surface, a sign frame assembly, a sign, and a plurality of fasteners. The base assembly tracks and the channel assembly tracks of the sign frame assembly are mounted to the mounting surface by the fasteners.

According to another aspect of the invention, the system for advertising further includes a tensioning tool. The tensioning tool includes an angle and a handle attached to the angle. The angle is placed onto the channel assembly track and the handle acts as a lever to aid in pressing the channel assembly track onto the base assembly track.

The sign frame assembly of the present invention utilizes a tensioning system with a relatively simple design which thereby reduces the costs of materials. The design also allows for easy assembly and tensioning of the sign to the sign frame assembly which reduces the cost of labor.

DETAILED DESCRIPTION OF THE PREFERRED EMBODIMENT

Figure 1:
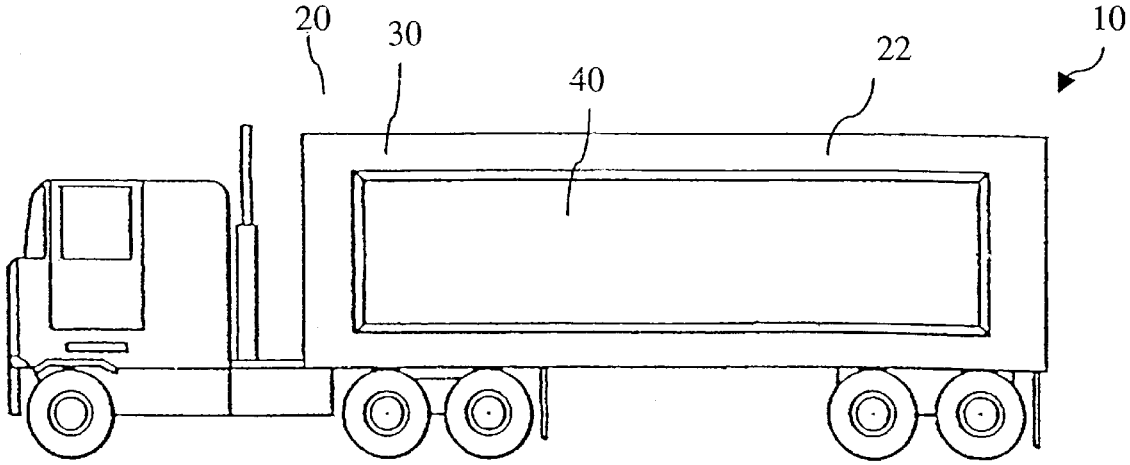
FIG. 1 is a side view of a system for advertising in accordance with the present invention.

Referring to FIG. 1, a system for advertising 10 according to the invention comprises a vehicle 20, a sign frame assembly 30, and a sign 40. Vehicle 20 includes a mounting surface 22 which may be any vertical side of the vehicle. Vehicles contemplated by the present invention include, for example, tractor trailer trucks, vans or other commercial vehicles having a sufficient mounting surface. It is understood that the present invention is not limited for use on vehicles, however, but may be employed on any mounting surface suitable for holding and displaying signs. Such mounting surfaces can include, for example, walls or building surfaces, railroad cars, or billboards.

Figure 2:
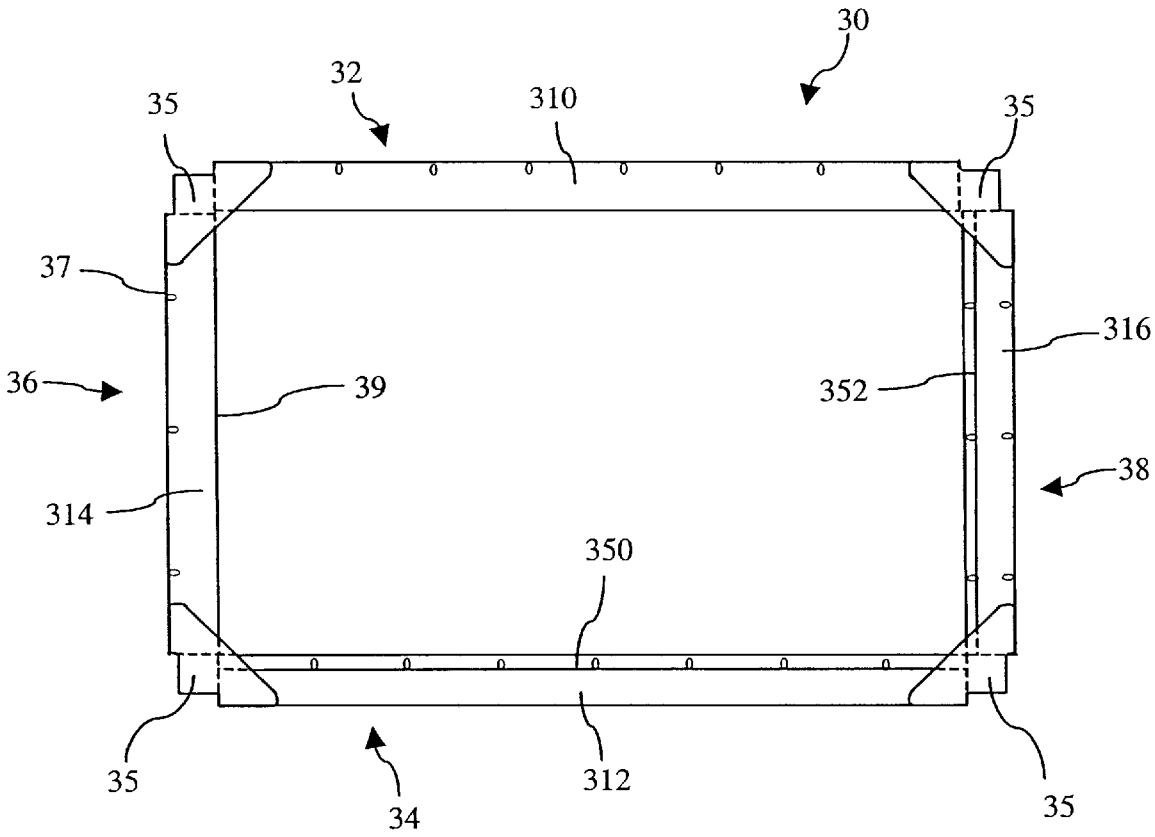
FIG. 2 is a front view of a sign frame assembly in accordance with the present invention.

Referring to FIG. 2, sign frame assembly 30 is rectangular in shape and comprises four channel assembly tracks, 310, 312, 314, and 316 and two base assembly tracks 350 and 352. The sign frame assembly 30 has a top side 32, a bottom side 34, a left side 36 and a right side 38. The sign frame assembly 30 has an outside edge 37 and an inside edge 39. In a rectangular shaped sign frame assembly, the channel assembly tracks 310, 312, 314, and 316 are used to construct all four sides of the sign frame assembly 30 and the base assembly tracks 350 and 352 are used to construct only two consecutive sides of the sign frame assembly 30. Thus, two sides of the sign frame assembly are composed of only a channel assembly track and two sides of the sign frame are composed of a combination of a channel assembly track and a base assembly track. The channel assembly and base assembly tracks are preferably composed of aluminum, but may be composed of other metals or of a polymer. The tracks are formed preferably by extrusion, but other methods such as, for example, casting may be employed. The length of the tracks may be varied as necessary to meet the particular application.

The sign frame assembly 30 may also include corner caps 35 placed at all four corners. The corner caps 35 fit onto the ends of the channel assembly tracks and base assembly tracks providing an aesthetically pleasing finish to the frame assembly. The corner caps are the same thickness as the frame thus preventing the wind from entering the frame assembly at the corners and getting behind the sign panel. The corner caps are preferably formed of a polymer such as polyvinylchloride.

Figure 3A:
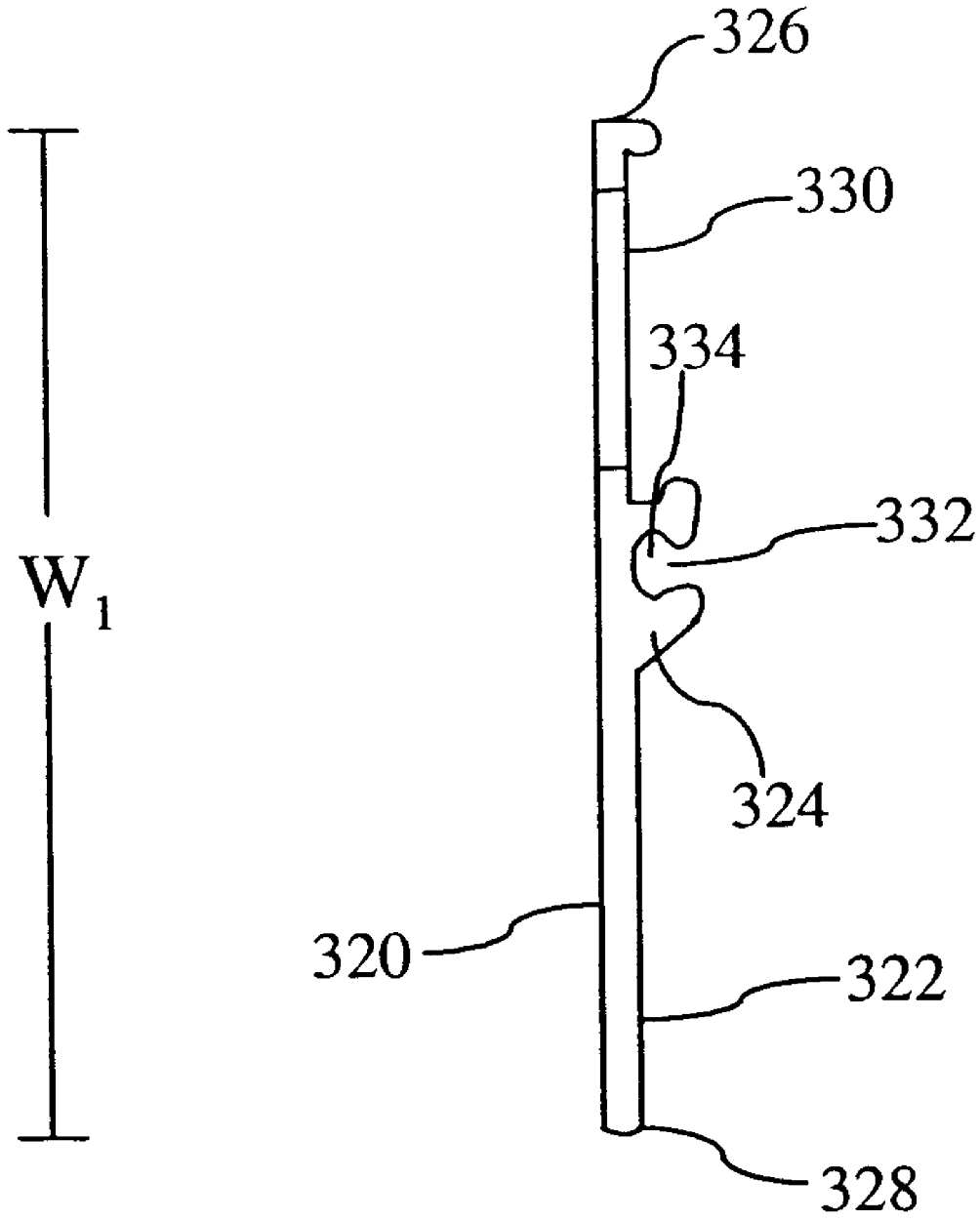
FIGS. 3A and 3B are a side and front view, respectively, of a channel assembly track.
Figure 3B:
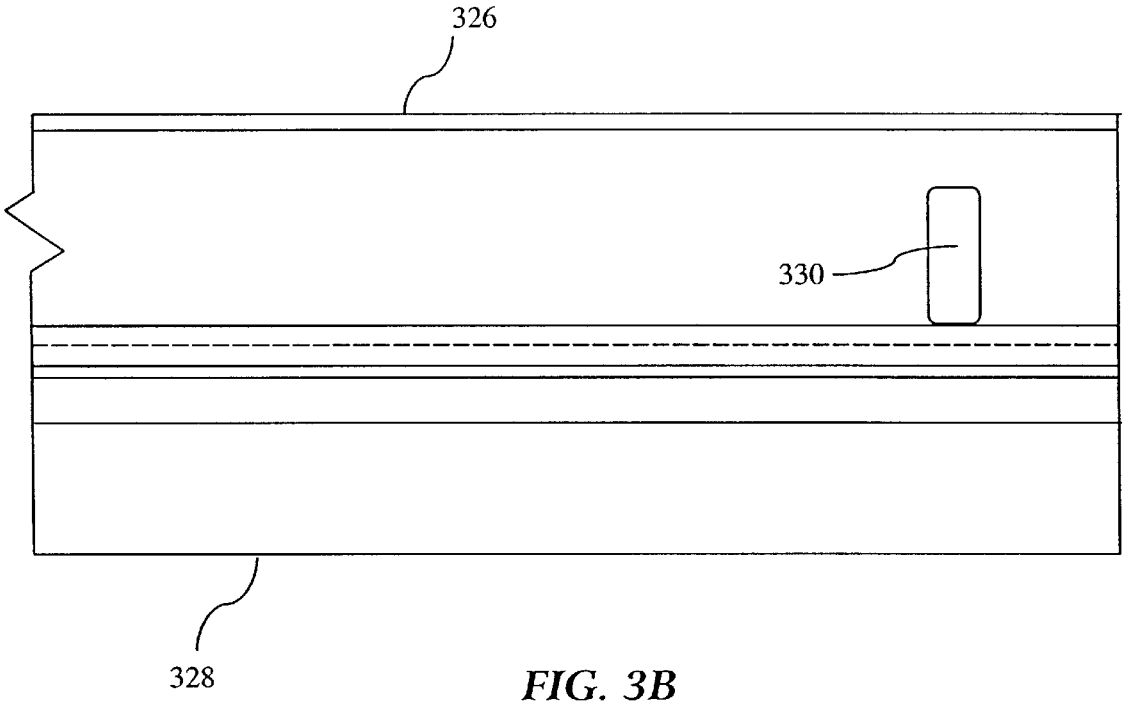

Referring to FIGS. 2, 3A and 3B, channel assembly tracks 310 (top track), 312 (bottom track), 314 (left track), and 316 (right track) comprise an internal side 320, an external side 322, a channel containing member 324, an outer edge 326, an inner edge 328, and elongated mounting holes 330. The channel containing member 324 runs the length or substantially the length of the track and defines an open ended elongated cavity 334. The channel containing member has an opening 332 which faces towards the outer edge 326 of the track. The cross section of the cavity is preferably substantially circular, but may have other configurations. The mounting holes 330 are preferably spaced at twelve inch intervals along the outer edge 326 of each track but such intervals may be shortened or lengthened depending on the application.

Figure 4A:
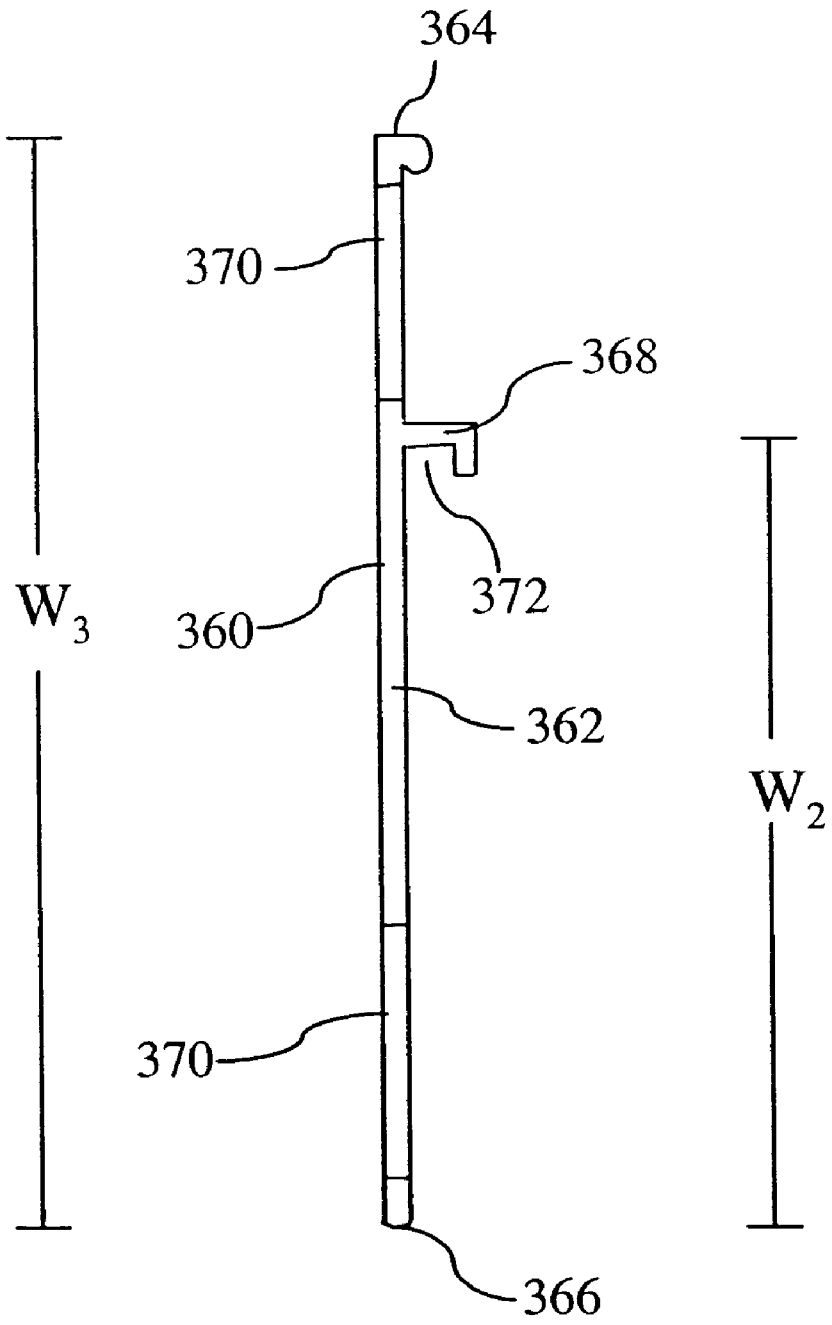
FIGS. 4A and 4B are a side and front view, respectively, of a base assembly track.
Figure 4B:
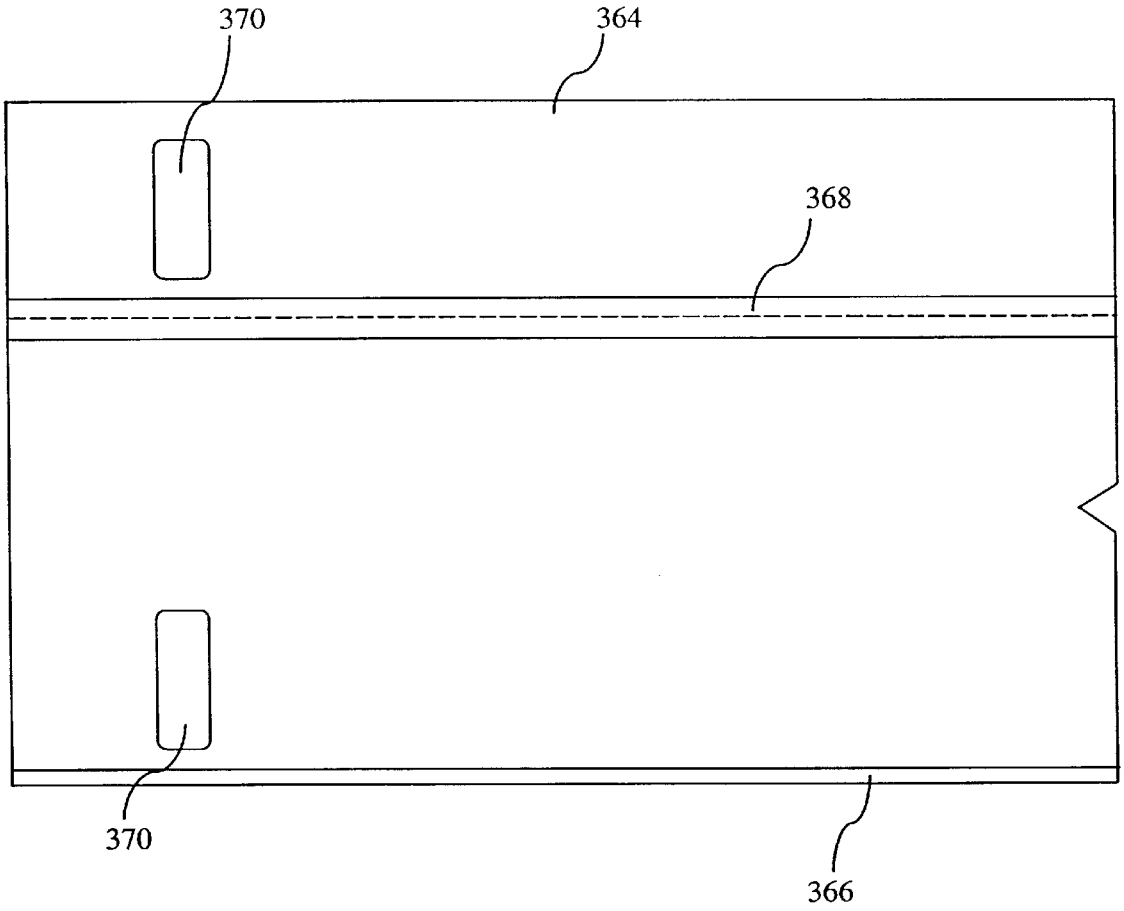

Referring to FIGS. 2, 4A and 4B, base assembly tracks 350 (bottom track) and 352 (right track) comprise an internal side 360, an external side 362, an inner edge 364, an outer edge 366, an anchoring pivot 368, and elongated mounting holes 370. The mounting holes 370 are preferably spaced at twelve inch intervals along the inner edge 364 and outer edge 366 of each base assembly track, but this interval may be shortened or lengthened depending on the application. The anchoring pivot 368 is substantially L-shaped and includes an opening 372 which faces the outer edge 366 of the base assembly track. The distance ($W_2$) from the anchoring pivot 368 to the outer edge 366 of the track 350 and 352 is equal to the width ($W_1$) of the channel assembly track. The lengths of the base assembly tracks 350 and 352 are equal to the lengths of the corresponding channel assembly tracks 312 and 316 and the mounting holes 370 of the base assembly tracks 350 and 352 correspond the mounting holes 330 of the channel assembly tracks 312 and 316. The width ($W_3$) of the base assembly tracks are preferably about four inches. This narrow width reduces the costs of materials necessary to make the tracks, provides for a more secure hold on the mounting surface by ensuring that the mounting holes on the inner and outer edges are spaced close together, and adds to the aesthetic appearance of the frame assembly by avoiding wide edges of the track which stick out from behind the sign.

Figure 5:
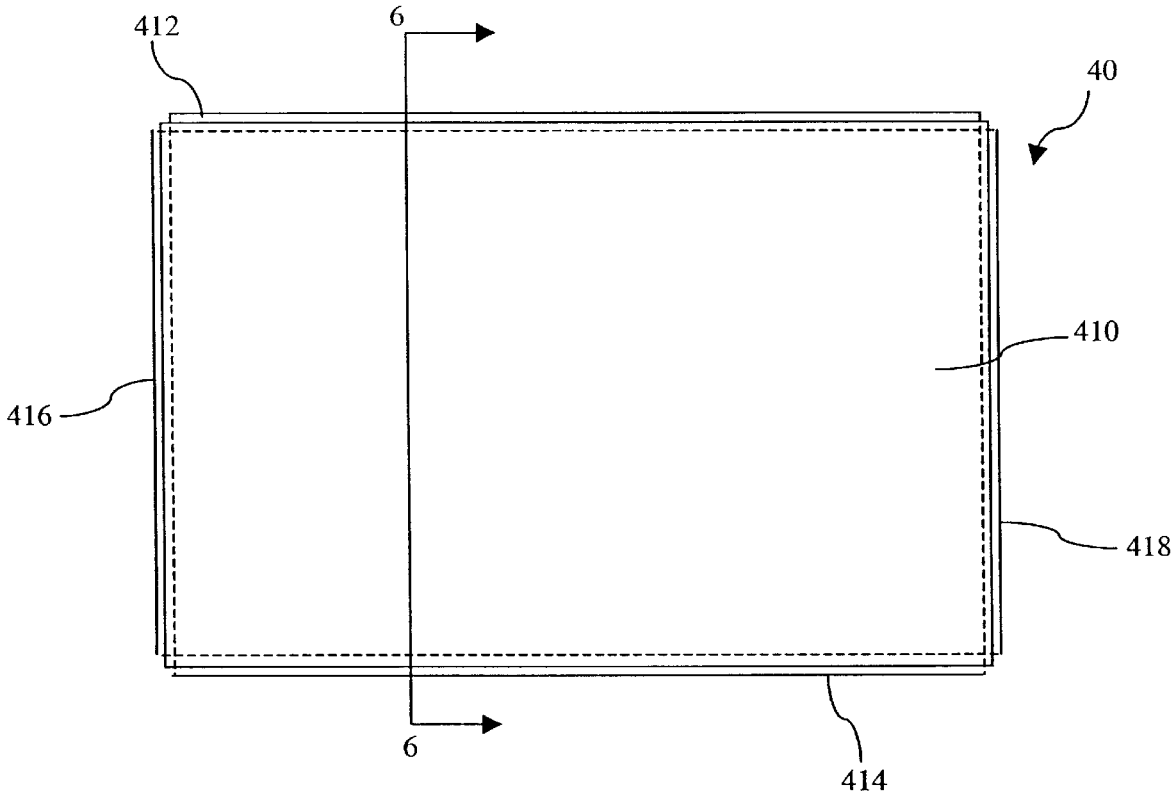
FIG. 5 is a front view of a sign according to the present invention.
Figure 6:
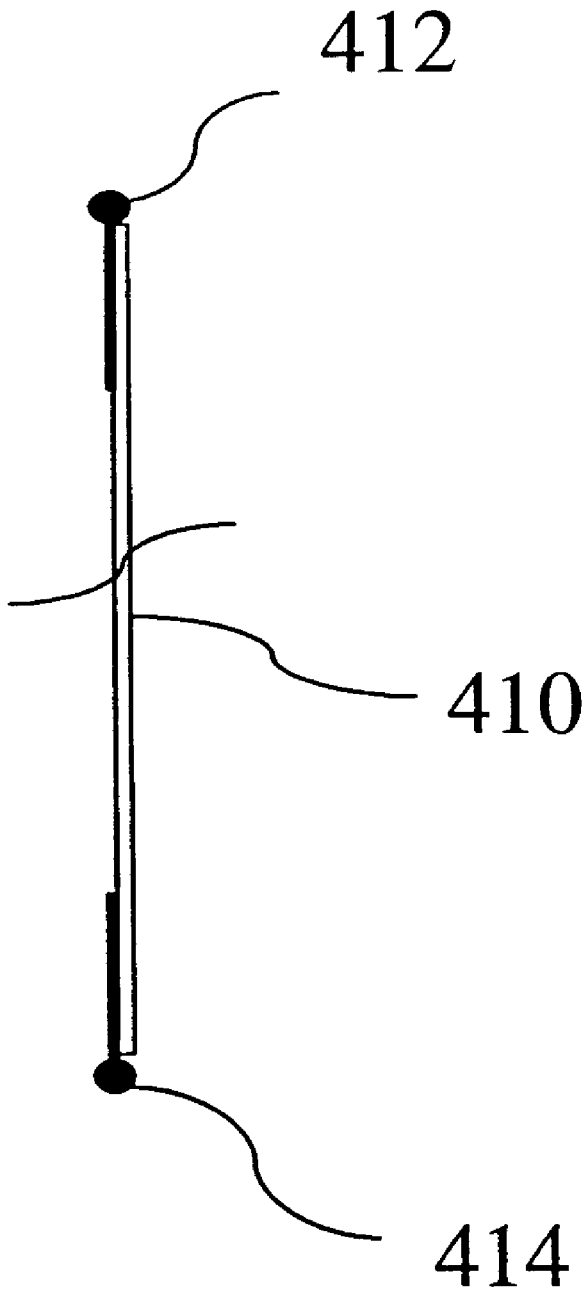
FIG. 6 is a cross-sectional view of the sign taken along line 6—6 of FIG. 5.

Referring to FIGS. 5 and 6, sign 40 comprises a sign panel 410 and four beaded sleeves 412, 414, 416, and 418. The sign panel 410 is a rectangular sheet of material which is preferably composed of flex vinyl but may be composed of other flexible materials such as, for example, canvass. It should be understood that the sign frame assembly 30 is adapted to accommodate not only sign panels of different flexible materials but also of different lengths, widths and thicknesses. The sign panel has about its periphery beaded sleeves 412 (top), 414 (bottom), 416 (left), and 418 (right). Preferably, the beaded sleeves 412, 414, 416, and 418 are attached along the edges of the sign panel 410 by, for example, welding or adhesive. One common method of attachment is radio frequency welding. The beaded sleeves 412, 414, 416, and 418 may, however, alternatively be sewn into a pocket formed from the sign panel, whereby the sign panel is folded back over itself and sewn together to form a pocket into which the beaded sleeve is placed. Each beaded sleeve 412, 414, 416, and 418 runs substantially the length of the corresponding side of the sign panel 410 and is shaped such that the sleeve fits within the cavity 334 of the channel containing member 324 of the channel assembly tracks 310, 312, 314, and 316. The shape of the cross section of the beaded sleeves may be varied to fit the configuration of the cross-section of the cavity 334 of the channel containing member 324. The beaded sleeves 412,414, 416, and 418 may be formed by extrusion and are preferably composed of polyvinylchloride, but may be composed of any suitable material, such as other plastics or wood.

Referring to FIGS. 12A, 12B, 13 and 14, a specially designed tensioning tool 500 is shown for drawing the channel assembly track against the base assembly track. The tensioning tool comprises an angle 510 and a handle 520. The angle is preferably formed of steel and is preferably about one-eighth inch thick, about nine inches long (L), and has sides which are about one and a half inches wide (W). The handle 520 is preferably about nine inches long and one inch square and formed of mechanical tubing made of steel. The handle 520 has a distal end 522 and a proximal end 524. The proximal end 524 is cut at a forty-five degree angle. The distal end 524 is preferably fitted with a plastic end cap 526. A notch 512 measuring one inch in diameter is cut into one side of the angle 510. See FIG. 13. The proximal end 524 of the handle 520 is set into the notch 512 so that the edge of the proximal end 524 is flush against the angle 510. The handle 520 is then welded to the angle 510 at all adjoining surfaces.

Figure 7A:
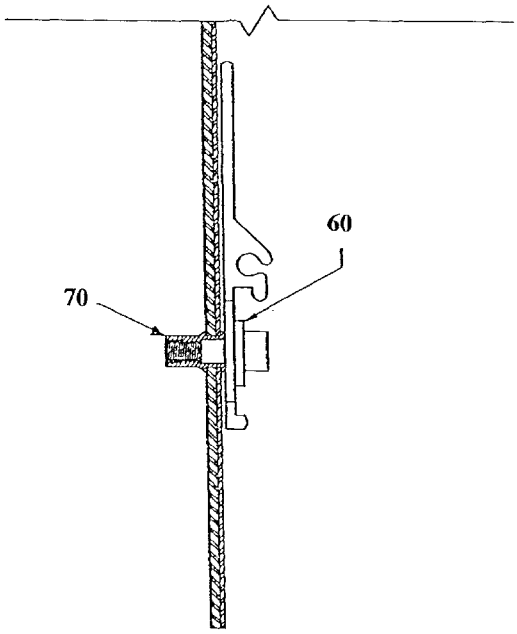
FIGS. 7A and 7B are side views of a channel assembly track and a combination of a channel assembly track and base assembly track, respectively, mounted to a mounting surface (shown without the sign)
Figure 7B:
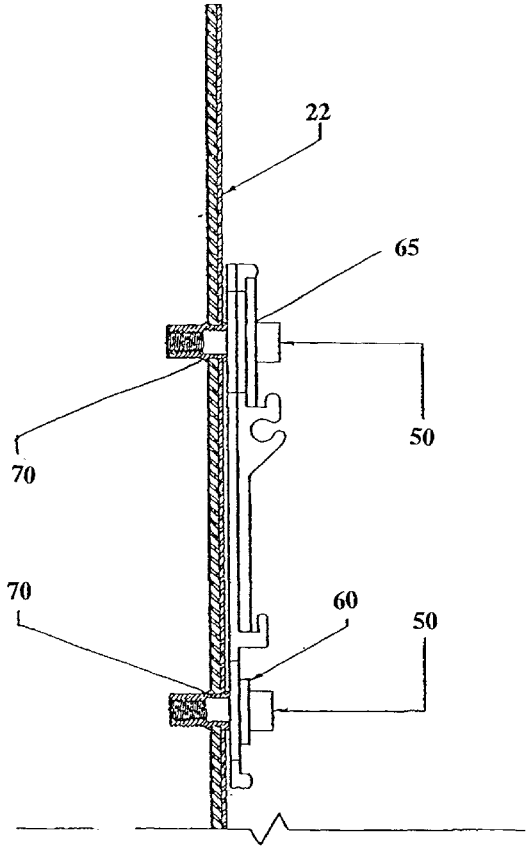
Figure 8:
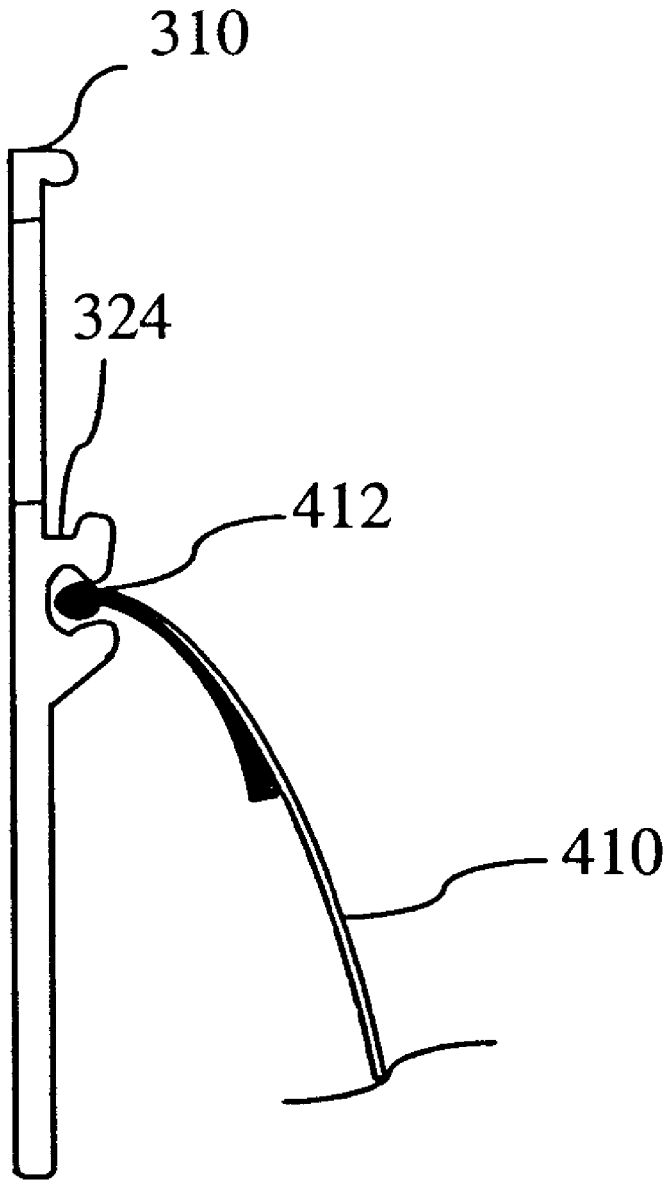
FIG. 8 is a cross-sectional view of a beaded sleeve held within a channel assembly track.
Figure 9A:
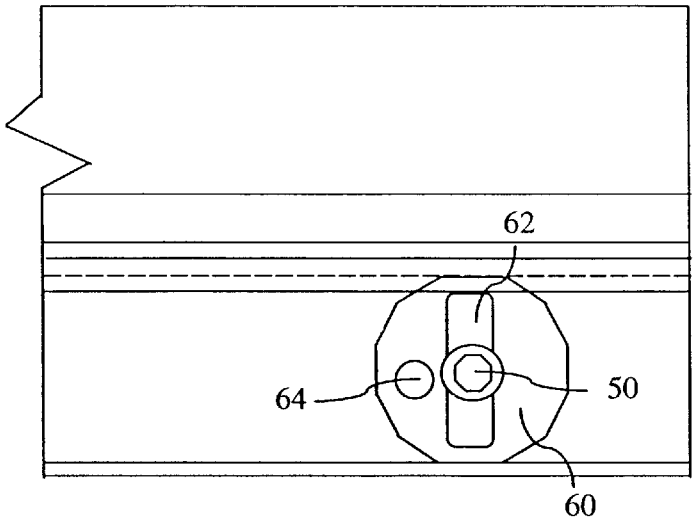
FIGS. 9A, 9B and 9C, are front views of a channel assembly track mounted on a base assembly track.
Figure 9B:
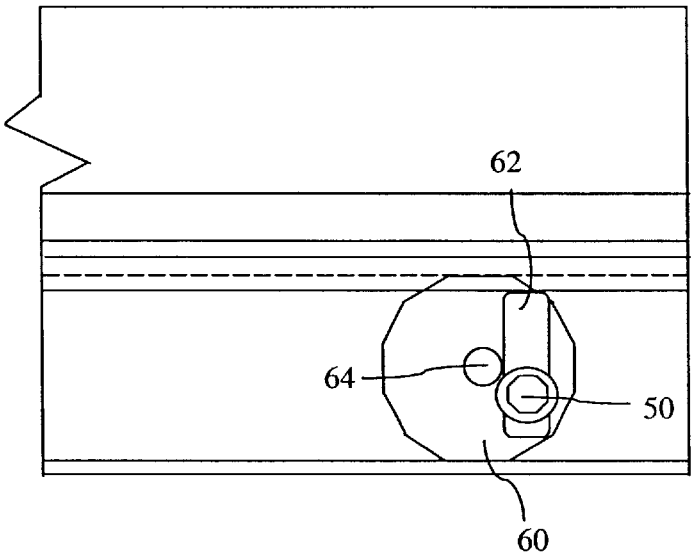
Figure 9C:
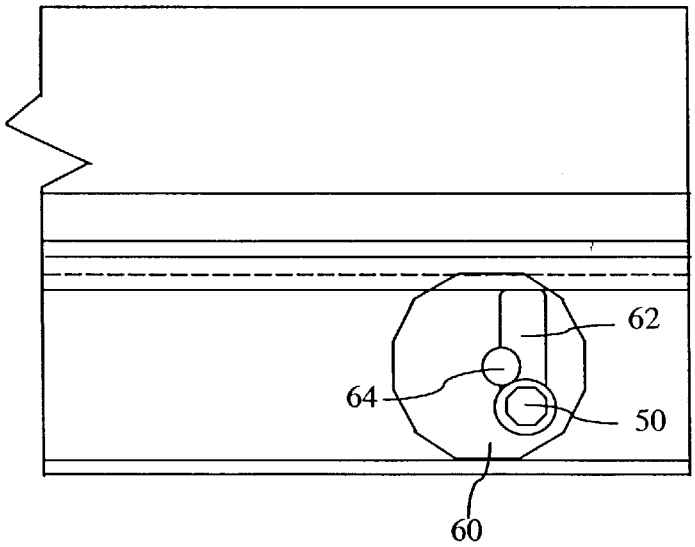

According to certain inventive aspects, vehicle 20, sign frame 30 and sign 40 are assembled in the following manner. See FIGS. 7A and 7B. One channel assembly track of the sign frame 30 is mounted to the mounting surface 22 of the vehicle 20 (or wall of building or billboard). For purposes of this illustration, top channel assembly track 310 is mounted on the top side of the rectangle that will make up the top side 32 of the sign frame assembly. The channel assembly track 310 is mounted such that the opening 332 of the channel containing member 324 faces towards the outside edge 37 of the sign frame assembly 30. After mounting top channel assembly track 310, beaded sleeve 412 is inserted through the cavity 334 of the channel containing member 324 such that the beaded sleeve is held within the channel containing member 324 and sign panel 410 protrudes through the opening 332 of the channel containing member 324. See FIG. 8. Next, a beaded sleeve on a consecutive side of the sign panel 410 already attached to the mounted channel assembly track 310 is inserted into the cavity 334 of the channel containing member 324 of the channel assembly track corresponding to that side of the sign panel 410. For purposes of this illustration, left beaded sleeve 416 is inserted through the cavity 334 of channel containing member 324 of left channel assembly track 314. The channel assembly track 314 is then mounted on the mounting surface 22 to make up the left side of the sign frame assembly 30 in such a way that the opening 332 of the channel containing member 324 faces the outside edge 37 of the sign frame assembly 30. The two channel assembly tracks 310 and 314 are mounted so that the inside edges 328 of the two tracks almost touch each other. If the inside edges 328 did intersect, they would create a right angle.

The type of fasteners and method of fastening the channel assembly tracks 310 and 314 to the mounting surface 22 will vary depending on the type of mounting surface. Typically, holes are first drilled into the mounting surface 22 that will correspond to the mounting holes on the channel assembly tracks and, where applicable, the base assembly tracks. These holes in the mounting surface are then equipped with an anchoring device. If mounting onto a vehicle side formed of aluminum, the anchoring device will ordinarily be an open-ended internally threaded rivet 70 which attaches to the aluminum surrounding the hole. See FIGS. 7A and 7B. In most cases, the channel assembly tracks 310 and 314, when not in combination with a base assembly track, will be fastened to the mounting surface 22 by inserting a fastener 50 through a washer 60 and then through the mounting holes 330 of the channel assembly tracks 310 and 314 and finally through the anchoring device 70 and mounting surface 22. Where the mounting surface is a vehicle side composed of aluminum, the fastener 50 is preferably a #8 hex head cap screw and the washer 60 is #8 flat washer. The cap screw is then screwed into the threads of the anchoring device. Mounting surfaces such as fiberglass, concrete or brick may require different mounting fasteners and anchoring devices such as would be obvious to those skilled in the art.

The other two consecutive sides of the rectangular sign frame assembly (for the purposes of this description, the bottom side 34 and right side 38) are formed by anchoring a combination of the channel assembly track 312 and 316 and the base assembly track 350 and 352 to the mounting surface 22. See FIGS. 7A and 7B. The base assembly tracks 350 and 352 are mounted first. They perform an anchoring function facilitating the mounting of the channel assembly tracks and sign to the mounting surface. The base assembly tracks 350 and 352 are mounted in such a way that the opening 372 of the anchoring pivot 368 faces the outer edge 37 of the sign frame assembly 30. The base assembly tracks 350 and 352 are initially mounted to the mounting surface 22 by inserting a fastener 50 through a washer 60 and then through the mounting holes 370 along the inner edge 364 of the base assembly tracks and finally through the anchoring device 70 and mounting surface 22. As above with respect to mounting the channel assembly tracks, the fasteners 50 may vary according to the mounting surface 22. Where the mounting surface is a vehicle side composed of aluminum, the fastener 50 is preferably a #8 hex head cap screw and the washer 60 is #8 flat washer. Upon mounting the base assembly tracks 350 and 352, the inner edge 364 on the ends of each base assembly track 350 and 352 will almost touch the inner edge 364 on the end of the neighboring base assembly track and the inner edge 328 on the end of the neighboring mounted channel assembly track 310 and 314.

Figure 10:
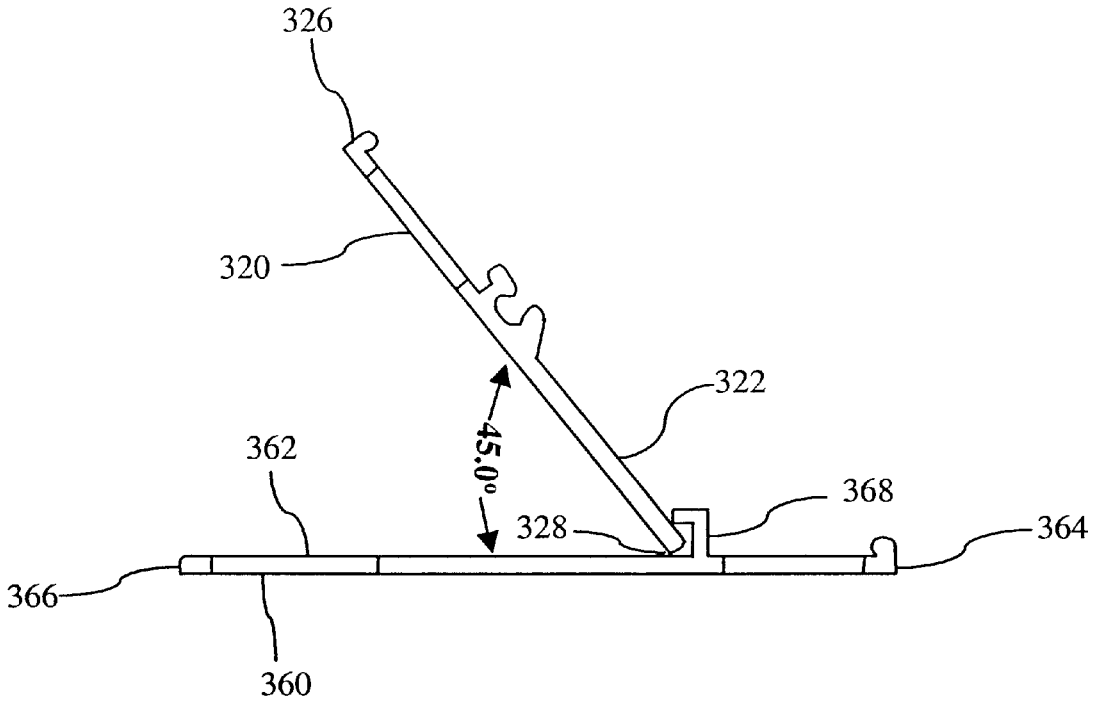
FIG. 10 is a side view of a channel assembly track placed within the anchoring member of the base assembly track prior to tensioning (shown without the sign)

The remaining two sides of the sign frame assembly 30 may be concluded by interlocking or anchoring the two remaining channel assembly tracks 312 and 316 onto the base assembly tracks 350 and 352 which have already been mounted. The first step is to fasten one of the remaining channel assembly tracks 312 or 316 to the beaded sleeve 414 or 418 that corresponds to that track. For the purposes of this example, the bottom channel assembly track 312 is first attached to the corresponding bottom beaded sleeve 414. This is accomplished by running the beaded sleeve 414 along the cavity 334 in the channel containing member 324. When doing this, the opening 332 should face away from the mounting surface 22 and should face the outside edge 37 of the sign frame assembly 30. Once the beaded sleeve 414 is attached to the channel assembly track 312, the inner edge 328 of the channel assembly track 312 is placed inside the opening 372 of the anchoring pivot 368 of the corresponding base assembly track 350. The tension created from the attachment of the channel assembly track 312 to the sign 40 should prevent the internal side 320 of the channel assembly track 312 from resting on top of the external side 362 of the base assembly track 350. See FIG. 10.

Figure 11:
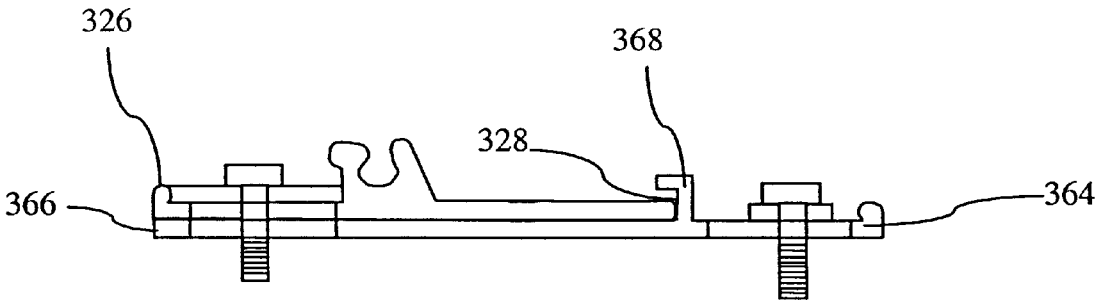
FIG. 11 is a side view of the channel assembly track and base assembly track after tensioning (shown without the sign)
Figure 12A:
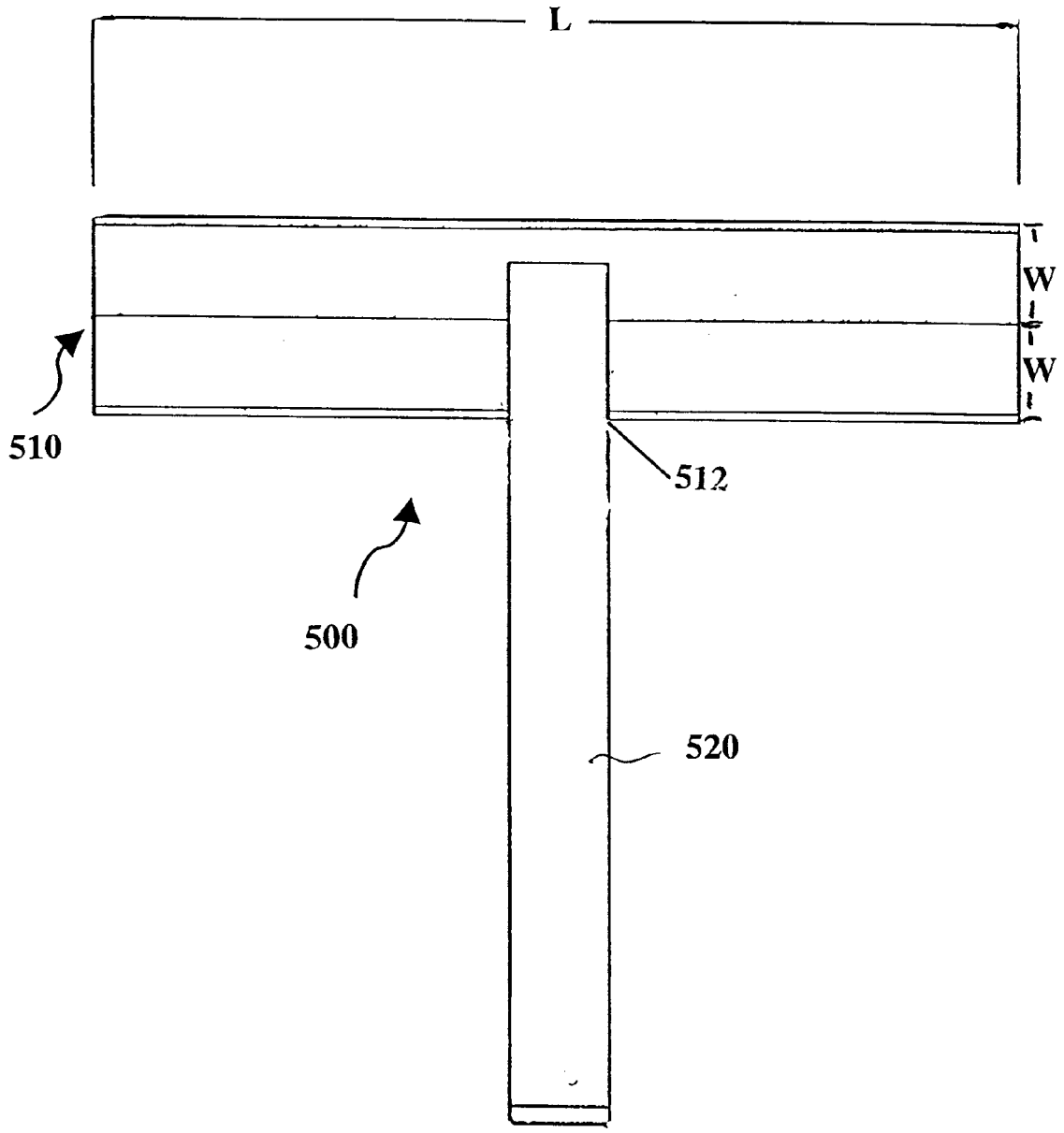
FIGS. 12A and 12B are a top view and a side view, respectively, of a tensioning tool in accordance with the present invention.
Figure 12B:
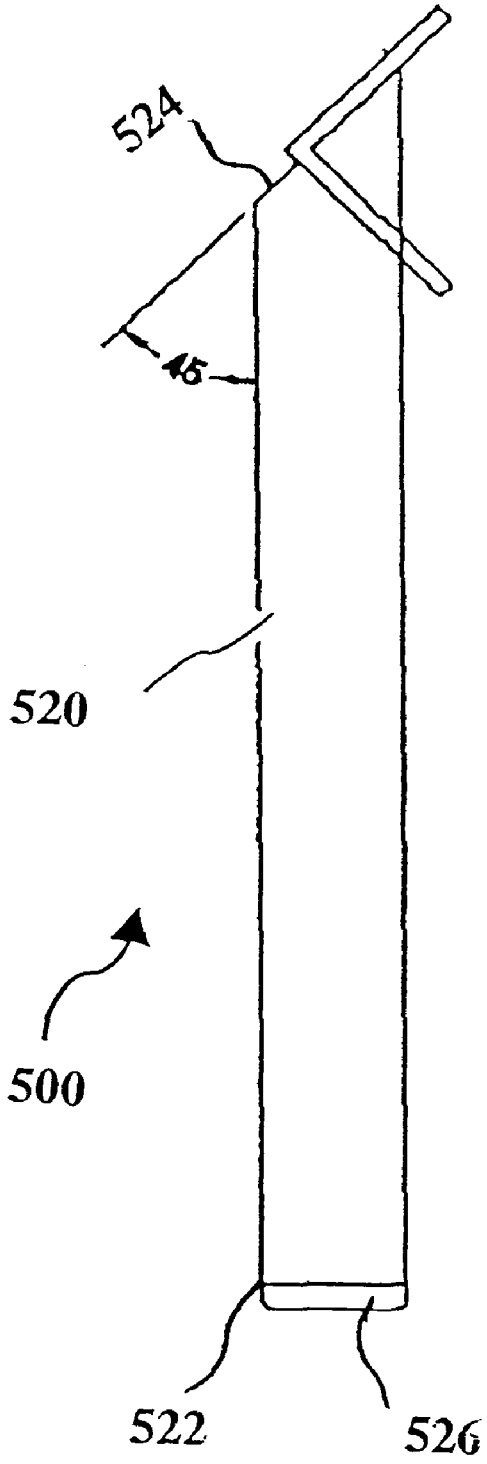
Figure 13:
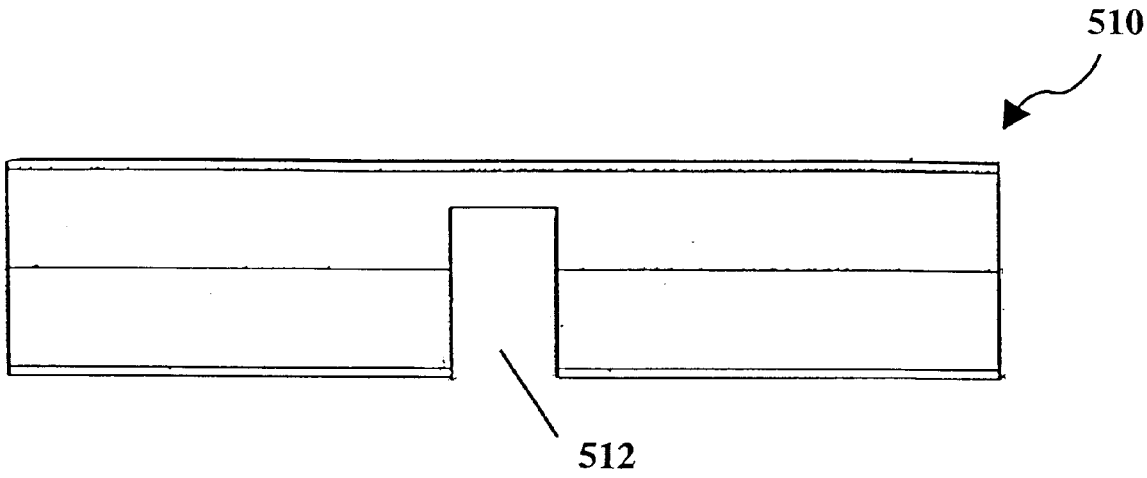
FIG. 13 is a top view of the angle of the tensioning tool.
Figure 14:
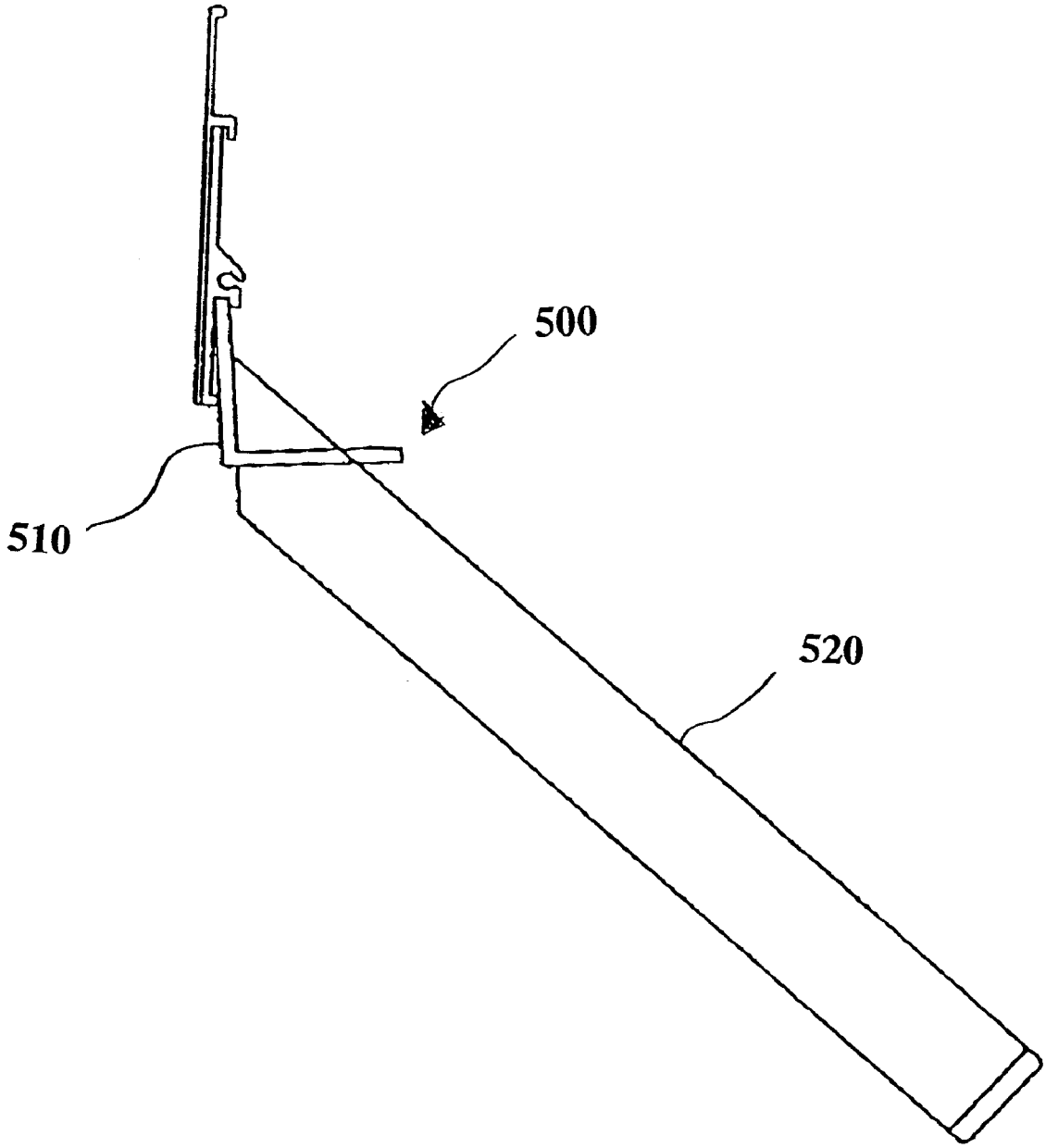
FIG. 14 is a side view of the tensioning tool shown being applied to draw the channel assembly track to the base assembly track.

Using the tensioning tool 500 specifically designed for this purpose, see FIG. 14, leverage is applied to the channel assembly track 312 to pivot the channel assembly track 312 so that the internal side 320 of the channel assembly track 312 lays flush against the external side 362 of base assembly track 350. See FIG. 11. To accomplish this, the angle 510 of the tensioning tool 500 is placed onto the channel assembly track and the handle 520 of the tensioning tool 500 is pressed towards the mounting surface until the channel assembly track is flush against the base assembly track. See FIG. 14. The tensioning tool is not necessary to draw the channel assembly track to the base assembly track and it is contemplated that other means obvious to those skilled in the art may be employed to pivot the channel assembly track onto the surface of the base assembly track. For example, a crowbar or similar tool can be used for this purpose.

Once in place, the channel assembly track 312 is mounted to the base assembly track 350 and to the mounting surface 22 by inserting a fastener 50 through a washer 65, then through the mounting holes 330 along the outer edge 326 of the channel assembly track 312, then through the mounting holes 370 along outer edge 366 of the base assembly track 350, and finally through the anchoring device 70 and mounting surface 22. Here, the washer 65 is preferably a twelve-sided adjustable washer having two holes. The advantage of the two-holed adjustable washer is that it can be rotated to fit where the elongated mounting holes meet the anchoring devices. This allows for some margin of error when drilling the holes into the mounting surface. Again, the apparatus for mounting may vary depending on the mounting surface.

To complete the mounting and assembly of the sign frame assembly 30 and sign 40, channel assembly track 316 is attached to beaded sleeve 418 by running beaded sleeve 418 through the cavity 334 in the channel containing member 324 of the channel assembly track 316. Again, the opening 332 should face away from the mounting surface 22 and should face the outside edge 37 of the sign frame assembly 30.

As above, with respect to installation of the third side of the sign frame assembly 30, the next step is to place the inner edge 328 of the channel assembly track 316 into the opening 372 of the anchoring pivot 368 of the corresponding base assembly track 352. The tension created from the attachment of the channel assembly track 316 to the sign 40 should prevent the internal side 320 of the channel assembly track 316 from resting on top of the external side 362 of the base assembly track 352. Again, using either a crowbar or similar tool or the tool specifically designed for this purpose, leverage is applied to the channel assembly track 316 to pivot the channel assembly track 316 so that it lays flush against the base assembly track 352.

The fourth side of the sign frame assembly is then mounted to the mounting surface 22 in the same way as described above with respect to the third side. A fastener 50 is inserted through a washer 65, then through the mounting holes 370 along outer edge 326 of the channel assembly track 316, then through the mounting holes 370 along outer edge 366 of the base assembly track 352, and finally through the anchoring device 70 and mounting surface 22.

When the fourth side of the sign frame assembly has been mounted to the mounting surface, a tensioning force is spread out uniformly over the entire surface of the sign panel. This results in an unwrinkled and planar surface for presentation of an advertising message. The interior of the sign panel is completely sheltered from the wind by the surrounding sign frame assembly and corner caps and therefore is resistant to wind damage.

Although, in the illustrated embodiment of the invention, the sign and sign frame assembly have been shown as being four sided, it will be appreciated that other shapes are also readily possible. The sign frame assembly and sign may have three sides, or five or more sides. Preferably, for frames having an even number of sides, half of the sides are comprised of a channel assembly track only, and the other half of the sides are comprised of a combination of the base assembly track and the channel assembly track. A side comprised of only a channel assembly track will be opposite a side comprised of a combination of a base assembly track and a channel assembly track as this will facilitate tensioning the sign panel. For frames having an odd number of signs, it is preferable to have one more side with a combination of tracks than with only the channel assembly track. It is also possible to manufacture a sign frame assembly and sign having curved edges. In such case, the beaded sleeves would be formed of a deformable material such as a plastics extrusion of relatively hard plastic.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A sign frame assembly having a plurality of sides, comprising:

a plurality of channel assembly tracks each including a channel containing member having an open ended cavity, and a plurality of base assembly tracks, wherein said base assembly tracks include an anchoring member;

a plurality of fasteners, wherein the channel assembly tracks are used to form all sides of the frame assembly, and wherein at least two sides of the frame assembly are formed of a combination of a base assembly track and a channel assembly track, and wherein the channel assembly track is mounted on top of the base assembly track by said fasteners; and further comprising:

a tensioning tool, wherein the tensioning tool includes, an angle having two sides, and a handle having a proximal end and a distal end, and wherein the proximal end of the handle is attached to the angle, and wherein the angle of the tensioning tool is placed onto the channel assembly track, and wherein the handle of the tensioning tool is rotated to press the channel assembly track onto the base assembly track.

2. The sign frame assembly of claim 1, wherein the anchoring member is a substantially L-shaped anchoring pivot, and wherein the channel assembly track is interlocked with the base assembly track by inserting an inner edge of the channel assembly track into an opening of the anchoring pivot of the base assembly track and pressing an internal side of the channel assembly track onto an external side of the base assembly track.

3. The sign frame assembly of claim 2, wherein the sign frame assembly has four sides, and wherein two consecutive sides are formed of only a channel assembly track and two consecutive sides are formed of a combination of a base assembly track and a channel assembly track, and wherein the channel assembly tracks further include mounting holes positioned along an outer edge of the channel assembly tracks, and wherein the base assembly tracks further include mounting holes positioned along an outer and an inner edge of the base assembly tracks, and wherein the channel assembly tracks are mounted to the base assembly tracks by fasteners inserted through the mounting holes on the outer edges of the channel assembly tracks and the base assembly tracks.

4. The sign frame assembly of claim 1, wherein the channel assembly tracks further include mounting holes positioned along an outer edge of the channel assembly tracks, and wherein the base assembly tracks further include mounting holes positioned along an outer and an inner edge of the base assembly tracks, and wherein the channel assembly tracks are mounted to the base assembly tracks by fasteners inserted through the mounting holes on the outer edges of the channel assembly tracks and the base assembly tracks.

5. The sign frame assembly of claim 4, wherein the mounting holes of the channel assembly track and base assembly track are spaced at twelve inch intervals.

6. The sign frame assembly of claim 1, wherein the channel assembly tracks and base assembly tracks are formed of extruded aluminum.

7. The sign frame assembly of claim 1, wherein the cavity of the channel containing member has a substantially circular cross section, and wherein the channel containing member and cavity run substantially the length of the channel assembly tracks.

8. The sign frame assembly of claim 1, wherein the sign frame assembly further includes a plurality of corner caps, and wherein the corner caps cover ends of the base assembly tracks and the channel assembly tracks.

9. The sign frame assembly of claim 1, wherein the base assembly tracks are about four inches wide.

10. A sign frame and sign assembly, comprising:

a sign, including, a sign panel having a plurality of sides, and a plurality of beaded sleeves, wherein the plurality of beaded sleeves are attached, one each, to each side of the sign panel, and a sign frame, including, a plurality of channel assembly tracks, wherein said channel assembly tracks include a channel containing member which runs substantially the length of the channel assembly tracks, said channel containing member defining a cavity and including an opening, and a plurality of base assembly tracks, wherein said base assembly tracks include an anchoring member, and a plurality of fasteners, and wherein the channel assembly tracks are used to form all sides of the frame assembly, and wherein at least two sides of the frame assembly are formed of a combination of a base assembly track and a channel assembly track, and wherein the channel assembly track is mounted on top of the base assembly track by said fasteners, and wherein the beaded sleeves of the sign are held within the cavity of the channel containing member of the channel assembly tracks, and wherein the sign panel protrudes through the opening of the channel containing member; and further comprising;

a tensioning tool, wherein the tensioning tool includes, an angle having two sides, and a handle having a proximal end and a distal end, and wherein the proximal end of the handle is attached to the angle, and wherein the angle of the tensioning tool is placed onto the channel assembly track, and wherein the handle of the tensioning tool is rotated to press the channel assembly track onto the base assembly track.

11. The assembly of claim 10, wherein the anchoring member is a substantially L-shaped anchoring pivot having an opening, and wherein one channel assembly track is interlocked with one base assembly track by inserting an inner edge of the channel assembly track into the opening of the anchoring pivot of the base assembly track and pressing an internal side of the channel assembly track onto an external side of the base assembly track.

12. The sign frame assembly of claim 10, wherein the channel assembly tracks further include mounting holes positioned along an outer edge of the channel assembly tracks, and wherein the base assembly tracks further include mounting holes positioned along an outer and an inner edge of the base assembly tracks, and wherein the channel assembly tracks are mounted to the base assembly tracks by fasteners inserted through the mounting holes on the outer edges of the channel assembly tracks and the base assembly tracks.

13. The assembly of claim 10, wherein the sign panel is composed of flex vinyl.

14. The assembly of claim 10, wherein the beaded sleeves are welded onto the sign panel, and wherein the beaded sleeves run substantially the length of the cavity of the channel containing member.

15. The assembly of claim 10, wherein the cavity of the channel containing member has a substantially circular cross-section, and wherein the beaded sleeves have a substantially circular cross-section.

16. The assembly of claim 10, further including corner caps, wherein the corner caps fit onto the ends of the channel assembly and base assembly tracks.

17. A system for advertising, comprising:

a mounting surface, and a sign, including, a sign panel having a plurality of sides, and a plurality of beaded sleeves, wherein the plurality of beaded sleeves are attached, one each, to each side of the sign panel, and a sign frame, including, a plurality of channel assembly tracks, wherein said channel assembly tracks include a channel containing member which runs substantially the length of the channel assembly tracks, said channel containing member defining a cavity and including an opening, and a plurality of base assembly tracks, wherein said base assembly tracks include an anchoring member, and a plurality of fasteners, wherein the channel assembly tracks are used to form all sides of the frame assembly, and wherein at least two sides of the frame assembly are formed of a combination of a base assembly track and a channel assembly track, and wherein the channel assembly track is mounted on top of the base assembly track by said fasteners, and wherein the beaded sleeves of the sign are held within the cavity of the channel containing member of the channel assembly tracks, and wherein the sign panel protrudes through the opening of the channel containing member, and wherein the base assembly tracks and the channel assembly tracks are mounted to the mounting surface by the fasteners; and further comprising;

a tensioning tool, wherein the tensioning tool includes, an angle having two sides, and a handle having a proximal end and a distal end, and wherein the proximal end of the handle is attached to the angle, and wherein the angle of the tensioning tool is placed onto the channel assembly track, and wherein the handle of the tensioning tool is rotated to press the channel assembly track onto the base assembly track.

18. The assembly of claim 17, wherein the anchoring member is a substantially L-shaped anchoring pivot having an opening, and wherein one channel assembly track is interlocked with one base assembly track by inserting an inner edge of the channel assembly track into the opening of the anchoring pivot of the base assembly track and pressing an internal side of the channel assembly track onto an external side of the base assembly track.

19. The advertising system of claim 17, wherein the channel assembly tracks include mounting holes spaced along an inner edge, and wherein the base assembly tracks include mounting holes spaced along an inner edge and an outer edge, and wherein the channel assembly tracks and the base assembly tracks are mounted to the mounting surface by inserting the fasteners through the mounting holes and into the mounting surface.

20. The advertising system of claim 17, wherein the fasteners for mounting the channel assembly tracks and base assembly tracks to the mounting surface include screws and washers.

21. The advertising system of claim 20, wherein the screws are #8 hex head cap screws and the washers are 12 sided and include two holes, and wherein the screws are inserted into one of the two holes of the washer before being inserted through the mounting holes of the channel assembly tracks and base assembly tracks.

22. The advertising system of claim 17, further including anchoring devices, wherein said anchoring devices are attached to holes drilled into the mounting surface.

23. The advertising system of claim 22, wherein said anchoring devices are internal threaded rivets, and wherein the rivets are attached to a hole drilled into the mounting surface, and wherein the fasteners are mounted to the mounting surface through the rivets.

24. The advertising system of claim 17, wherein the mounting surface is the side wall of a vehicle.

25. The advertising system of claim 24, wherein the vehicle is a tractor trailer.

26. The advertising system of claim 17, wherein the mounting surface is the side of a building.

27. The advertising system of claim 17, wherein the mounting surface is a billboard.

28. The advertising system of claim 17 wherein one side of the angle includes a notch cut into said side, and wherein the proximal end of the handle is cut at an angle, and wherein the proximal end of the handle is set within the notch and welded to the angle.

* * * * *